United States Patent [19]

Bradt

[11] 4,211,736

[45] Jul. 8, 1980

[54] PROCESS FOR FORMING AND TWISTING FIBERS

[75] Inventor: Rexford H. Bradt, Warsaw, Ind.

[73] Assignee: Albert L. Jeffers, Fort Wayne, Ind. ; a part interest

[21] Appl. No.: 763,890

[22] Filed: Jan. 31, 1977

Related U.S. Application Data

[63] Continuation of Ser. No. 608,881, Aug. 29, 1975, abandoned, and Ser. No. 440,983, Feb. 11, 1974, Pat. No. 3,920,362, which is a continuation of Ser. No. 301,611, Oct. 27, 1972, abandoned, which is a continuation-in-part of Ser. No. 96,305, Dec. 9, 1970, abandoned.

[51] Int. Cl.[2] ..... B22D 23/08

[52] U.S. Cl. ..... 264/8; 264/12; 264/103; 425/7; 425/8

[58] Field of Search ..... 264/8, 103; 65/14, 6; 425/7, 8

[56] References Cited

U.S. PATENT DOCUMENTS

| | | | |
|---|---|---|---|
| 1,500,931 | 7/1924 | Hooper | 264/8 |
| 1,500,932 | 7/1924 | Hooper | 264/8 |
| 1,549,843 | 8/1925 | Meurer | 264/12 |
| 2,207,764 | 7/1940 | Soubier | 65/14 |
| 2,212,448 | 8/1940 | Modiglian | 65/14 |
| 2,522,526 | 9/1950 | Manning | 264/164 |
| 2,582,561 | 1/1952 | Peyches | 65/14 |
| 2,784,451 | 3/1957 | Bowen | 65/14 |
| 2,984,896 | 5/1961 | Hill | 264/12 |
| 3,649,232 | 3/1972 | Battigelli | 65/6 |
| 3,649,233 | 3/1972 | Battigelli | 65/6 |
| 3,649,234 | 3/1972 | Charpentier | 65/6 |

*Primary Examiner*—Jay H. Woo
*Attorney, Agent, or Firm*—Albert L. Jeffers

[57] ABSTRACT

A method of forming fibers from a flowable thermoplastic forming material wherein the fiber forming material is fed onto an outer surface of a spinning element which tapers inwardly to a terminal point and sweeping the fiber forming material with a flow of heated fluid along the surface of the spinning element and spinning the fiber forming material from the terminal point into congealed fibers under the continued influence of the sweeping fluid, cooling the uncongealed fibers to form a uniform suspension in the sweeping fluid and collecting the congealed fibers.

26 Claims, 16 Drawing Figures

PROCESS FOR FORMING AND TWISTING FIBERS

RELATED APPLICATION

The present application is a continuation of my divisional application, Ser. No. 608,881, filed Aug. 29, 1975 now abandoned, and of my copending application, Ser. No. 440,983 filed Feb. 11, 1974 entitled "APPARATUS AND PROCESS FOR FORMING AND USING PLASTIC FIBERS," now U.S. Pat. No. 3,920,362, which application was a continuation of my co-pending application Ser. No. 301,611 filed Oct. 27, 1972 now abandoned which application was a continuation-in-part of my co-pending application Ser. No. 96,305 filed Dec. 9, 1970 and now abandoned.

BACKGROUND OF THE INVENTION

Continuous synthetic fibers, or filaments, such as have been used in the textile industry have commonly been produced in one of two different ways. In one way a normally viscous material, such as a modified cellulose, for example, is forced through a spinneret and the emerging discrete streams are chemically treated to congeal the material and thereby form it into continuous filaments. In the other way, a thermoplastic resin is liquified, as by melting or dissolving it in an appropriate solvent, and forcing it through a conventional hole spinneret, and the emerging discrete streams congeal on cooling to form filaments. The latter method also has been used to form continuous filaments of glass adapted for various uses.

There are several disadvantages inherent in these methods. Production rates are limited, and the fine openings in the spinneret have a tendency to clog or plug up with material, thereby requiring either a new spinneret or a great deal of effort to correct the situation. It is also very difficult to make discontinuous, or short, fibers with any high degree of uniformity.

Inorganic "wools" for uses as heat insulation have been produced by treating a stream of molten slag, glass, or the like with a high-velocity stream of air, stream, or gas which shatters the molten material into fine fibers. Fibers so produced lack uniformity and frequently are characterized by beaded ends rendering them unsuitable for certain uses. Glass wool has also been produced by feeding a glass rod at right angle to the axis of and into a high velocity, turbulent gas flame which both melts the glass and shatters the melt into fibers. Fibers produced in these ways have wide variations in size and lengths and as a result of turbulence existing in such equipment, are rough, creped and weak.

It has further been proposed to create continuous fibers or filaments by drawing them under tension from points on the uninterrupted surface of molten baths of glass. Such a method is disclosed in U.S. Pat. No. 2,235,352 to Bates. According to the Bates disclosure, the locations on the bath surface from which the fibers are drawn are determined initially by use of a horizontally extending element the upper edge of which is serrated in effect. This element is first immersed in the bath to submerge the serrations and then raised to bring the serrations above the glass level. Once the drawing of filaments from the serrations has started, the serrated element is lowered beneath the bath surface and tension in the filaments continues to draw them from the bath. One drawback to this method is that the size and length of the fibers cannot be closely controlled, as they are formed from an excess pool of material, not a metered feed.

It is, therefore, an object of this invention to provide a process by which liquid congealable materials can be formed into fibers with a high degree of uniformity in length and cross-section and under conditions capable of control with precision and of providing high production rates.

DESCRIPTION OF THE PRIOR ART

In Prior Art processes for twisting air dispersons of fibers called open-end spinning or turbine twisting, great difficulty is encountered wherein a narrow bat or sliver feed strip of combed staple serves as feed supply and is fed into the twister at a constant rate usually by matched pull rolls. Trouble encountered in denier variations is caused by variation in the weight or lack of uniformity of the strip being fed. To compensate for such variations it has been found necessary to feed three or four strips at once thus hoping to average out local variations in a given sliver and achieve a more uniform yarn.

A further problem associated with turbine spinning is caused by the blades or wires in the feedstrip opening device. These high speed teeth claw open or garnett the feederstrip hopefully into single fibers suspended in air which blows the fibers from the teeth. However, it is basic to the system that a pin or tooth which pulls a fiber from a feed mass will occasionally grab the fiber near its midpoint and bend it into a hairpin or doubled or folded form. Also occasionally a pin may pull two fibers at once in this manner. The thus hairpinned fibers do not dependably unfold in the brief air stream and are twisted in such form into a yarn. This gives a bulkier and less strong yarn than would be obtained if such folded fibers did not occur in the feed stream.

Another problem encountered with open end spinning as processed in air Turbines is that the rotary centrifuge buckets are mechanical devices rotated at tremendous speeds, i.e. 25,000 to 45,000 rpm. Even with gaseous fluid bearings such as are used on supercentrifuges, the maintenance of such is at best a major problem.

In contrast to the above Prior Art spinning devices, one of the object of this invention is to provide a process which employs small, stationary spinning pockets of a size similar to that used by the Turbine spinning method. Pocket diameters will range from one to six inches and have no moving parts. Pressurized fluid performs the air twisting action in these miniature spinning pockets or dust collectors.

It is an object of our invention to provide a process which does not have hairpinning because the fibers, when supplied by the fiberforming point spinning process is close coupled relationship to the twisting pockets no opening device is needed.

Another object of our invention is to provide a process having uniformity of feed rate in a point spinning fiber supplying device.

The above objects achieve in combination unusual and highly desirable results which has heretofore been impossible to perform in the textile industry.

It should be noted that the feeding of fibrous suspensions into silos, towers and the like, sometimes equipped with sweeps or impellers, has been previously disclosed in Prior Art.

SUMMARY OF THE INVENTION

This invention relates to the production of filaments or fibers by causing congealable liquid material to leave the tip of a pointed element to the outer surface of which the liquid is supplied and to products of various types made from such fibers of filaments. The liquid material may be either a molten thermoplastic; a solution of suitable material; or a normally liquid material such as a modified cellulose; or an incompletely polymerized plastic convertible by heat and further polymerization into a stronger thermoplastic or into a thermoset. After leaving the point, the fibers are congealed by subjecting them to an atmosphere with the appropriate congealing properties. The thermoplastic may be congealed simply by cooling; the dissolved material by evaporation of the solvent; the modified cellulose by heat or chemical treatment; and the incompletely polymerized plastic by a sprayed catalytic fog.

In preferred forms of my invention the congealable material is supplied in flowable form and at a controlled rate to a pointed element, hereinafter called a "spin-off point" while a stream of fluid, preferably gaseous, sweeps the material to the tip of the point and therefrom as a fine stream congealable into a fiber or filament. The fluid stream also attenuates the drawn off filament before it congeals. The fibers may be continuous or discontinuous. The length of the discontinuous fibers as well as the tapering of their end portions may be controlled by regulating the supply of liquid material to the spin-off point. By pulsing or controlled starving of the liquid feed, discontinuous fibers of a specific length may be formed.

By the use of supplemental streams of fluid or gas playing on the congealing or fully congealed filament, various effects may be produced. If the supplemental fluid stream flows in the same direction as the sweep fluid, tension can be introduced into the congealing filament to stretch orient it and promote its congealing in a straight form. If the supplemental fluid stream flows in the opposite direction and strikes the forming filament at an appropriate point, crimping in the finished filament will result. Depending on its composition or temperature supplemental fluid may effect or modify congealing of the liquid material into solid form.

A thread-like or yarn-like product may be produced from a congealable liquid by an apparatus comprising a circularrotatable head fitted with a plurality of spin-off points located about its periphery and all pointed in the same circumferential direction. As the head is rotated, centrifugal forces feed the liquid to the points, and tangentially blown sweep fluid, flowing in the same circumferential direction as the spin-off points are pointing, sweeps discontinuous incipient fibers therefrom, and the congealed fibers become combined and intertwisted by the swirling fluid to form a continuous thread, yarn, or the like.

Filaments may be felted or otherwise agglomerated to produce bats, sheets, or the like in a wide variety of sizes and characteristics. In materials so formed, the degree of cohesion holding the individual fibers in place can be controlled by controlling the extent to which filaments have congealed before being brought into contact with other filaments. If cohesion in the felted sheet is to be avoided, complete congealing of the fibers before deposition may be effected by treatment with a gas or fog containing a release agent.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
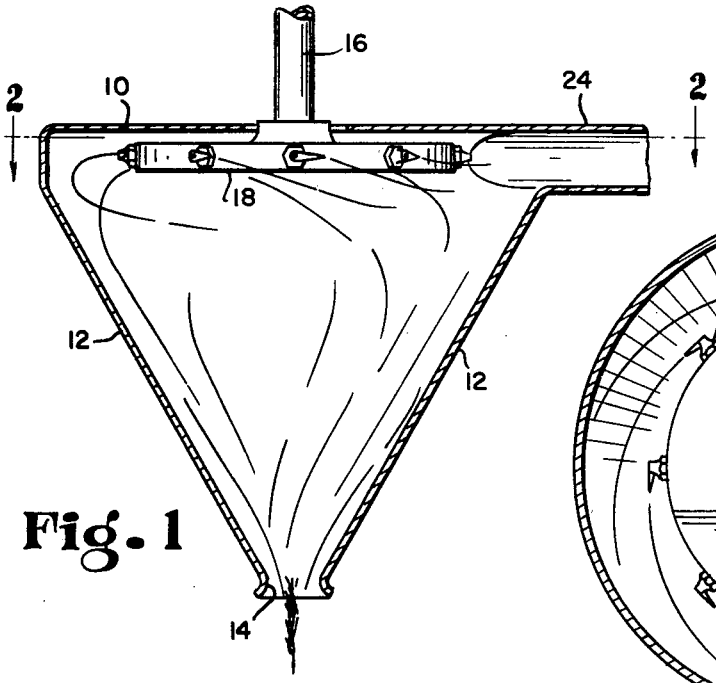
FIG. 1 is a vertical section showing fiber spinning apparatus for producing and twisting fibers.
Figure 2:
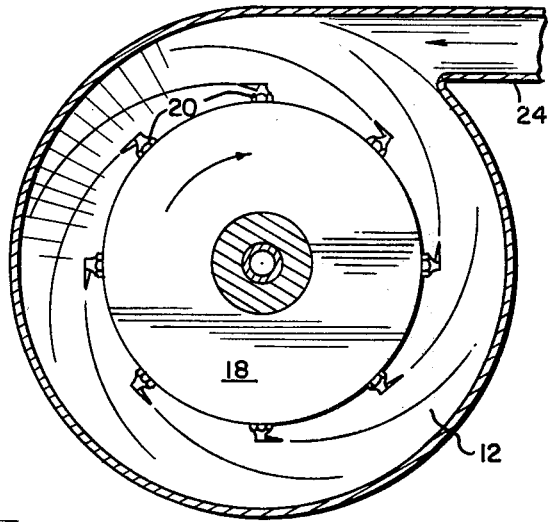
FIG. 2 is a section on the line 2—2 of FIG. 1.
Figure 3:
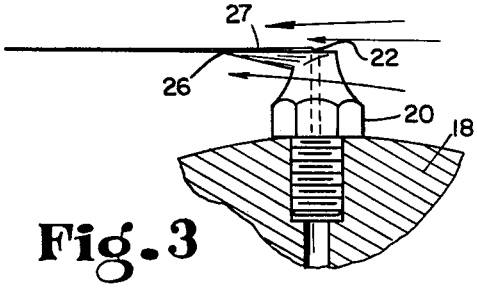
FIG. 3 is a sectional view on an enlarged scale illustrating a detail of construction.

FIGS. 1 through 3 illustrate apparatus for forming short fibers and combining them into a thread or the like. Such apparatus comprises a casing 10 having a conical wall 12 provided at its apex with an opening 14. A hollow shaft 16 extends through the upper wall of the casing 10 and supports therein a circular hollow head 18. The peripheral wall of the head 18 is provided with a series of radial holes 19 (FIG. 3) each of which has in its outer end a screw threadedly mounted discharge fitting 20. Each of the fittings 20 carries a tangentially projecting spin-off point 26 to which the congealable material 27 is supplied at a region spaced from the point via a passage 22 from the hole 19. The fittings 20 are so oriented about the axes of the hole 19 that the points 26 all project in the same circumferential direction, which is opposite to the direction of head rotation, indicated by arrow **18*a* in FIG. 2**.

Fluid, such as air, or other gas, is supplied to the casing 10 through a tangential inlet conduit 24 in about the plane of the head 18 and so arranged that the gas introduced through it will swirl in the casing in a direction opposite to that in which the head 18 rotates. The swirling gas acts on liquid 27 emerging from each passage 22 to cause the liquid to flow along the surface of the respective fittings 20 to the points 26 and to be carried therefrom as fine streams each of which, when congealed, will constitute a fiber.

A faster feed-to-sweep ratio gives continuous fibers or can give a mixture of continuous and discontinuous fibers if certain orifice flow control means are used to give some orifices faster feed than others. The effects thus attainable can form wooly twisted yarn with a core of continuous fibers.

The rate at which the congealable liquid is supplied to the extreme tip of the spin-off point is low enough that the fibers produced are discontinuous as explained below, and short relative to the size of the head 18. The fibers from the several points become entrained in the swirling gas, which acts to combine and intertwist the fibers into a continuous thread that can be withdrawn from the casing through the opening 14.

Figure 4:
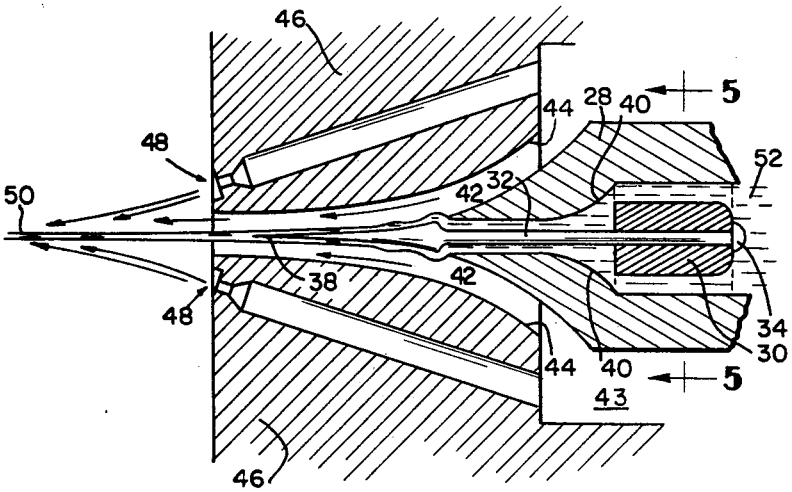
FIG. 4 is a sectional view of a device for forming single filaments.
Figure 5:
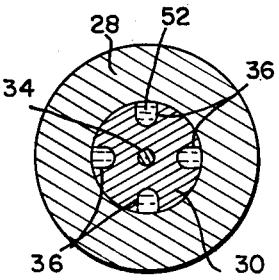
FIG. 5 is a section on the line 5—5 of FIG. 4.

An arrangement for forming a single filament in accordance with my invention is shown in FIGS. 4 and 5. In this structure a nozzle 28 is fitted interiorly with a point support 30 in which is mounted a spin-off point in the form of a solid needle-like member 32. The member 32 has a diameter less than that of the orifice of the nozzle 28 and extends forwardly through and beyond such orifice. A plurality of grooves 36 (FIG. 5) in the periphery of the support 30 permit congealable liquid material to flow past the support to the nozzle orifice and thence along the outer surface of the spin-off point 32 to the pointed tip end 38 thereof.

The nozzle 28 and the projecting spin-off point extend from the rear into a converging gas-passage 42 through which fluid, gas for example, flows from a supply conduit 43 to sweep liquid material on the spin-off point to and off the tip 38 as a fine stream which, on congealing, will become a filament. If the feed of liquid to the spin-off point is adequate, the filament can be continuous, but at lower feed rates, the sweep fluid passing through passage 42 may intermittently sweep the tip 38 of the spin-off point clean, thus interrupting filament-generation and causing the production of discontinuous fibers.

Figure 6:
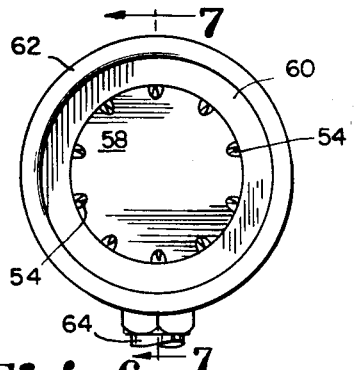
FIG. 6 is a front elevation of an apparatus containing a circular array of spin-off points.
Figure 7:
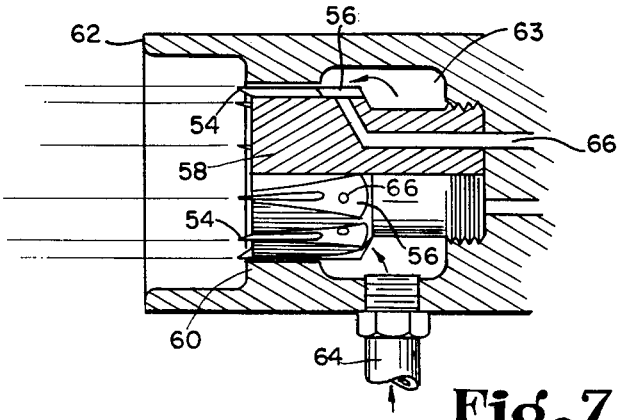
FIG. 7 is a section on the line 7—7 of FIG. 6.

As shown in FIG. 4, the body 46 in which sweep fluid passage 42 is formed contains a plurality of additional fluid passages disposed in forwardly converging relation around the passage 42 and terminating at their forward ends in discharge orifices 48 directed to discharge jets of fluid obliquely against the filament or against the fine liquid stream that is to congeal into a filament or fiber. The function performed by the jets from the orifices 48 depends upon several factors. If the congealable material is melted thermoplastic, jets having a temperature below the melting point of the material will further congeal and create tension in the congealing material to provide some stretch orientation and overcome any tendency of the still soft filament to contract as a result of its plastic memory. Further, the jets from the orifices 48 may contain catalysts or reagents necessary to effect chemical congealing of the liquid material leaving the spin-off point. Whatever material is used, if the jets do not participate in the congealing or setting of the filament, they still can be used to stretch, stabilize and refine the material. By using an annular series of nozzles 48 so oriented that the jet from each has a tangential velocity-component about the axis of the spin-off point, a twist will be imparted to the filament formed. Such twist imparts to the filament an appearance somewhat different from that of an untwisted filament. A similar series of similarly disposed nozzles about the axis of an annular series of spin-off points such as shown in FIGS. 6 and 7, and below described, will cause the several filaments respectively propelled from the points to be intertwisted as they are formed. Twisting effects, either on a single filament, or on a group of parallel filaments, can also be produced by an annular series of orifices such as shown in FIG. 4 and progressively pulsing the gas discharged from successive nozzles. Of interest is the observation, schematically indicated in FIG. 4, that a wave action is created by the sweep fluid and causes successive circular waves or thickening and thinning areas to flow along toward the tip of the point; thus providing a unique intermittent feed-flow effect which enhances formation of taper ended fibers.

An apparatus comprising a series of spin-off points arranged in a circle is shown in FIGS. 6 and 7. The spin-off points 54 are located respectively in axially extending grooves 56 formed in the circumferential surface of a cylindrical member 58. Each groove 56 is open at its front and rear ends, and the spin-off points project forwardly beyond the front ends of the grooves. The member 58 is snugly received in a central opening in an internal annular flange 60 in a hollow, cylindrical body 62. Surrounding the member 58 in rear of flange 60 is an annular plenum chamber 63 to which fluid under pressure is supplied through a conduit 64 and from which the fluid escapes in the axial direction through the grooves 56. The liquid material to be spun is supplied to the grooves near their rear ends through passages 66 in the member 58 and is carried by the escaping fluid to the tips of the spinning points.

The fiber formation in this case is like that hereinbefore described in that the congealable material, under the control of the sweeping action of the fluid supplied from chamber 63, encases the tip and sweeps the film of congealable material along the outer surface thereof and off the point to propel forwardly off each spin-off point a fine, congealable stream.

Figure 8:
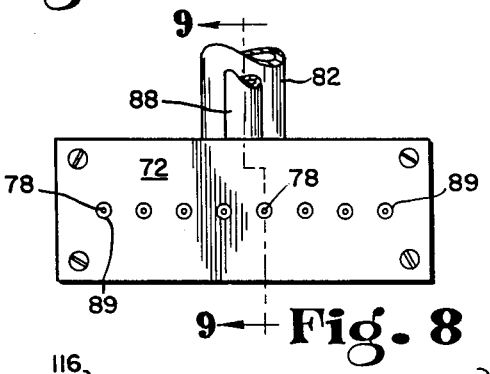
FIG. 8 is a front elevation of an apparatus with a linear array of spin-off points.
Figure 9:
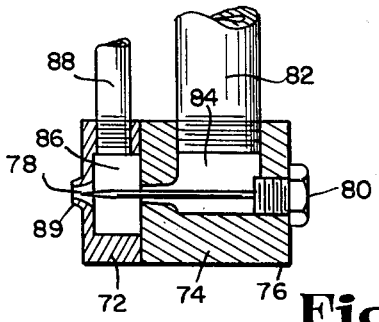
FIG. 9 is a section on the line 9—9 of FIG. 8.

A second multiple spin-off point arrangement, in which the several spin-off points are disposed in a common plane, is shown in FIGS. 8 and 9. The body comprises three portions 72, 74 and 76 to facilitate the provision of the necessary internal cavities. Each of the spin-off points 78 is the outer end portion of a solid member 79 fitted in a screw 80 which is received in the rear body portion 76. Congealable material is supplied from pipe 82 into supply chamber 84 which is common to all the spin-off point members in the apparatus. Forwardly of this supply chamber 84, and separated therefrom by a wall 85, is a chamber 86 which is supplied with pressurized sweep fluid through a pipe 88. The members 78 extend through holes of larger diameter in the wall 85 and across the chamber 86, their front ends, which constitute the spin-off points proper, projecting into nozzles 89 provided on body portion 72. The length and diameter of the fibers produced are affected by the longitudinal position and the general form of the spin-off points 78.

Figure 10:
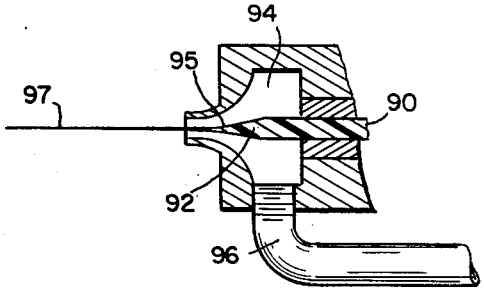
FIG. 10 is a fragmental section showing apparatus for making fibers from a rod of meltable material.

A variation upon our spin-off filament apparatus is shown in FIG. 10. A rod 90 of a thermoplastic material with a pointed conical end 92 is positioned within a chamber 94 with its pointed end entering an outlet nozzle 95. Fluid entering the chamber 94 via inlet pipe 96 is hot enough to melt the material on the surface of the rod, and, as the fluid flows along such surface and exits through nozzle 95, it causes the melted material to flow on the as yet unmelted core to the point thereof from which it leaves as a fine stream 97 congealable into a filament upon cooling. The point 92 is self-rejuvenating as long as the rod is steadily fed into the hot sweep fluid at an appropriate rate. The longitudinal position of the tip 92, the velocity of sweep fluid and the temperature thereof determine the length and diameter of the filament to be swept. As long as the feed of the unmelted rod 90 is balanced against the amount of material being swept from the point 92, continuous fibers may be formed at a below turbulent sweep fluid speed which permits a high degree of uniformity in the fiber's diameter. Discontinuous fibers may be produced by intermittently interrupting the feed of the rod or pulsing the sweep fluid. If the rod 90 is of a thermoplastic resin it may be formed by an extruder and fed directly therefrom and thereby into chamber 94 through a suitable guide channel. If the rod 90 is composed of glass, the coaxial, non-turbulent sweep fluid will make either high quality continuous or discontinuous glass fibers without need of the customary platinum spinnerets.

Figure 11:
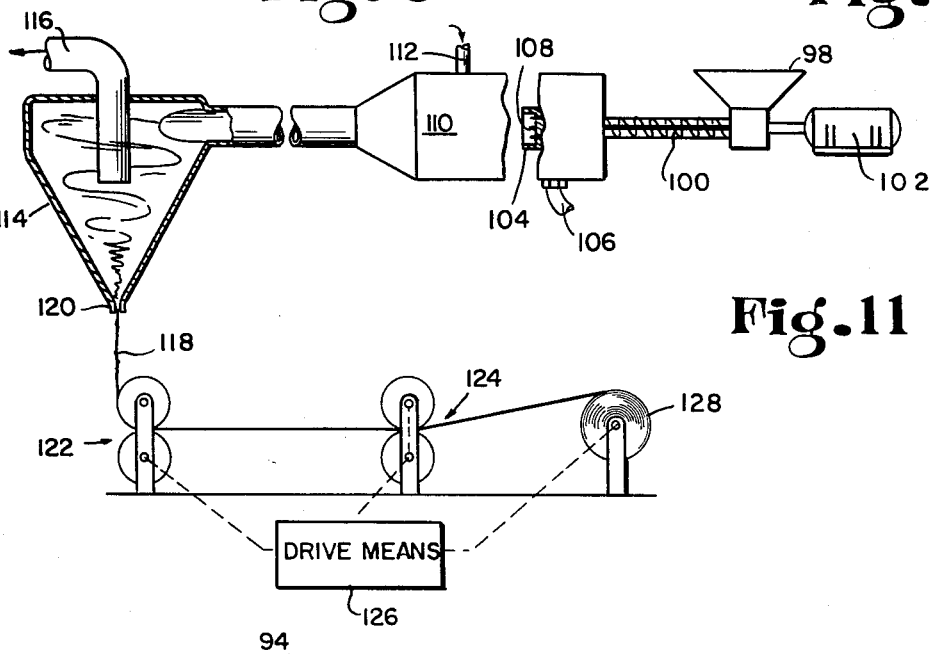
FIG. 11 is a side elevation depicting apparatus for intertwisting into a thread or yarn fibers formed therein.

Apparatus for producing a thread or yarn from discontinuous fibers formed from spin-off points is shown in FIG. 11. Typically, melted thermoplastic or other congealable material is placed in a hopper 98 and fed by an extruder 100 to a fiber forming device 104, which may be of the general type shown in FIGS. 6–7 and 8–9. Fluid under pressure supplied to this device 104 through intake 106 sweeps the spin-off points 108 of device 104 to form discontinuous incipient fibers delivered to a plenum chamber 110. The chamber 110 is supplied with fluid of the proper temperature and pressure through tangential inlet pipe 112 to partially cool, congeal, and surface treat the incipient fibers to control the amount of cohesion between the respective fibers in the twisted thread or yarn to be formed. Fluids supplied to intakes 106 and 112 may be recirculated through temperature and pressure control devices (not shown) in order to conserve and control fluid composition as, for example, maintain an inert or non-oxidizing fluid composition.

The suspension of semi-cooled fibers then enters tangentially into a conical chamber 114 generally of the form used in dust separators of the so called "cyclone" type and of a size ranging from 1 inch to 6 inches in diameter. Fluid escapes from the chamber 114 through outlet conduit 116, causing a whirlpool of fluid rotating at high speeds, as for example over 25,000 revolutions per minute, to exist within such apparatus.

In the chamber 114, the fibers are twisted together into a thread-like or yarn-like form 118 which is pulled from the lower end 120 of the chamber 114 by a pair of pulling rollers 122 driven by drive means 126. A set of tension rollers 124, driven at a greater speed than the pulling rollers 122, applies tension to the thread for stretch orienting its fibers, before it is taken up on takeup roller 128. This orientation of the fibers after twisting is effective because the fibers' high degree of uniformity promotes uniform distribution of the tensile stress among the several fibers. By stretching the thread after twisting instead of before, a helical set is given the individual fibers which enhances uniformity in the tensile stress on each. This overcomes the disadvantage of conventional non-uniformly loaded threads wherein many fibers may break before others assume any tensile loading at all.

Figure 12:
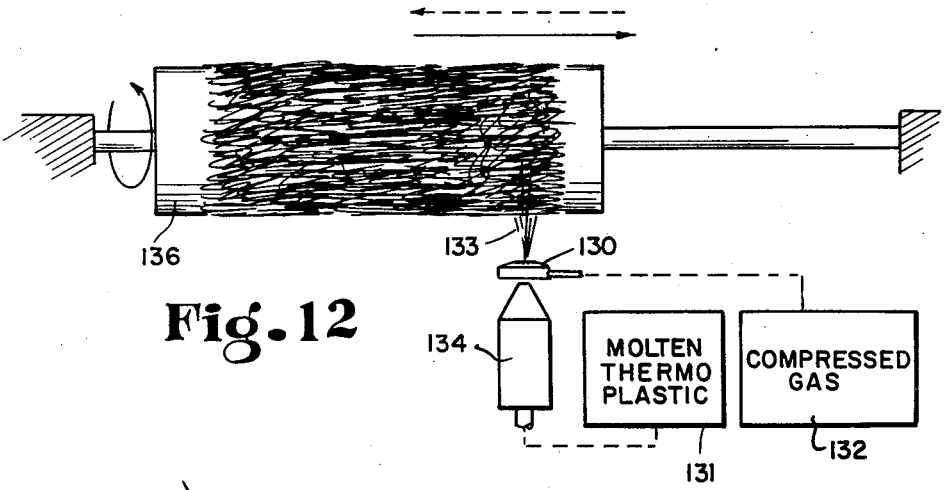
FIG. 12 is a diagrammatic showing of a system for felting fibers into a sheet or bat.

The felting system depicted in FIG. 12 may incorporate, as indicated at 134, any of the spin-off point devices shown in FIGS. 1 through 9, and 15 and 16 using a molten thermoplastic 131 as the filament material. An annular accelerating ring or collar 130 may surround the filament or filaments 133 emerging from the device 134 to discharge fluid against those filaments in a direction such as to stretch them and assure their impingement upon a rotating and reciprocating drum 136. As this drum 136 is moved axially back and forth, as shown by the arrows, it is slowly rotated, steadily or incrementally, as the impinging fibers form a mat or sheet on its surface. The fineness of the fibers produced, along with the speed with which the drum rotates and reciprocates, determine the nature of the felted material produced.

The surface of drum 136 can also be used to impart a texture or design to the formed sheet. For example, if a screen mesh constitutes or is placed on the surface of the drum 136 the resultant sheet will have a screen mesh texture. The use of any other embossed base will likewise cause the sheet to have a corresponding appearance. By first coating the drum 136 with a release agent followed by a layer of polyvinyl chloride plastisol plastic and thereafter impinging the hot fibers and carrying fluid thereon, a reinforced web-backed vinyl sheet can be produced in a one step, single machine operation. Similarly flaccid surface effects can be obtained on any heat sensitive bondable surface.

Figure 13:
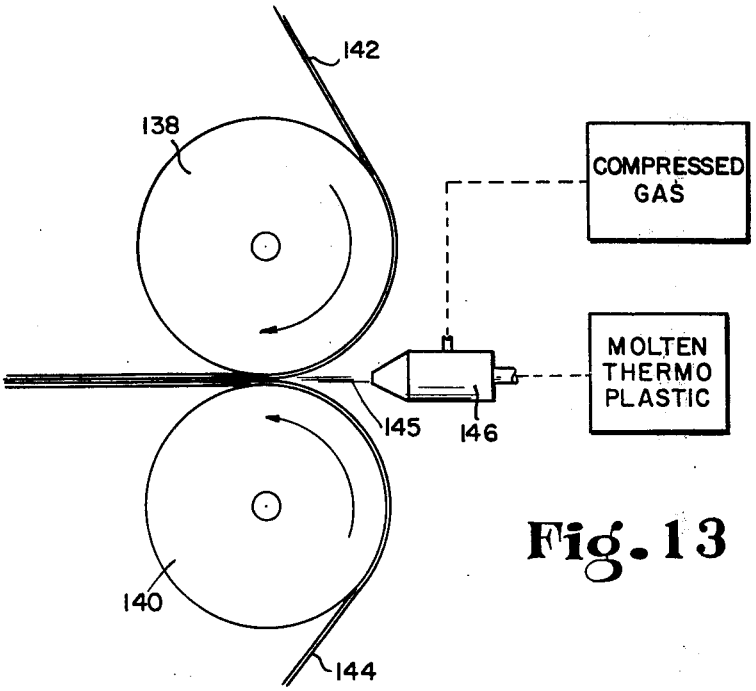
FIG. 13 is a representation, partially diagrammatic, of a system for producing a faced bat.

A variation of this apparatus is shown in FIG. 13. Here, two rotating drums 138 and 140 feed two strips or sheets 142 and 144 of fabric, for example, in parallel spaced relation as a layer of hot felted filaments 145 formed by a spin-off point apparatus 146 is deposited between them. This sandwiched hot layer of thermoplastic fibers adheres to and bonds together the two fabrics 142 and 144 and can provide a permanent insulating layer between them.

Figure 14:
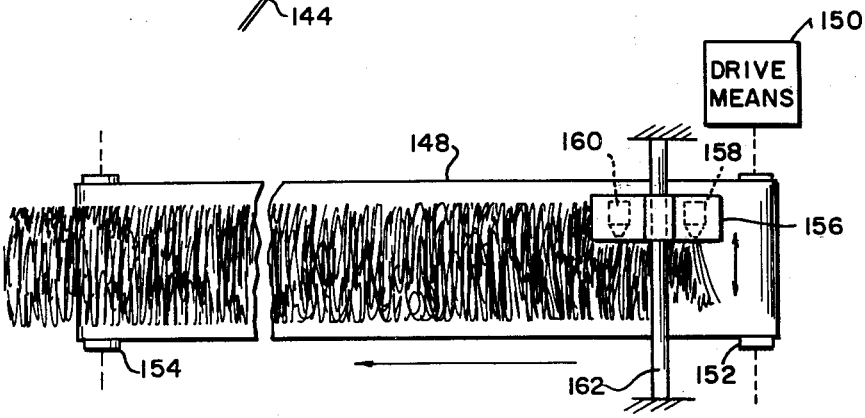
FIG. 14 is a diagrammatic showing of apparatus for producing multi-layered material.

In another felting apparatus, shown in FIG. 14, a conveyor belt 148 driven by a drive means 150 on rollers 152 and 154 can be used as the impinging target or to carry an impinging target. This target, as above, may be of any material or may have any surface texture which is desired to impart to the felted sheet to be formed. Head support 156 carries two spin-off heads 158 and 160 on guide member 162 extending transversely of belt 148. Conveyor belt 148 is moved in the direction shown and the head support 156 is moved back and forth on its guide 162 to deposit the filaments across the belt. In the absence of any auxiliary fluid jet, or jets, serving to deflect laterally the filaments discharged from a spin-off head, such filaments will be deposited in generally parallel relationship. The angle between those generally parallel filaments and the direction in which the belt 148 moves is largely determined by the orientation of the head relative to the path of belt movement, but will be influenced to an extent by the relation between the speed of belt movement and the speed of movement of the support 156. By depositing on a layer of filaments oriented in one direction a second layer in which the filaments are oriented in another direction an appearance simulating that of a woven fabric can be created. Where a plurality of heads are used variations in appearance can be created by supplying the heads with materials of different colors. In felted sheets simulating fabrics in appearance successively deposited layers of filaments will be bonded together either by the cohesiveness of still soft filaments or by an adhesive sprayed on or otherwise applied.

Figure 15:
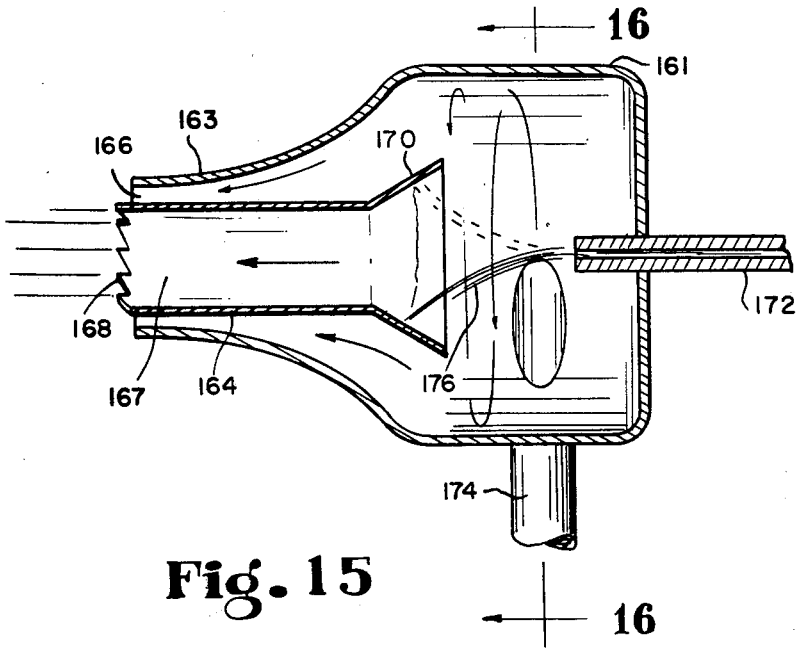
FIG. 15 is an axial section showing an embodiment in which filaments are spun from an annular series of spin-off points.
Figure 16:
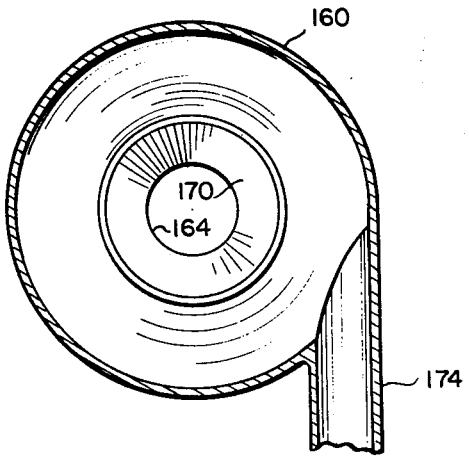
FIG. 16 is a cross-section on the line 16—16 of FIG. 15.

FIGS. 15 and 16 illustrate a spin-off head which, like those of FIGS. 6–7 and 8–9, simultaneously produces a plurality of filaments or fibers. This head comprises a hollow circular casing 161 which tapers at its front end to a nozzle-like portion 163. Mounted axially within the nozzle 163 is a tubular sleeve 164 of smaller diameter than the nozzle and providing annular openings 166 and 167. At its front end, the sleeve 164 is serrated to provide an annular series of spin-off points 168 and at its rear end it terminates in a funnel-like flange 170. On the axis of the head and spaced rearwardly from the rear end of flange 170 is the outlet of a conduit 172 through which is supplied the material to be spun. Axially between the flange 170 and the outlet of conduit 172, the interior of casing 161 communicates with a tangentially discharging conduit 174 for sweep fluids, such as air or gas.

In operation of the device shown in FIGS. 15 and 16, fluid such as air, or other gas, entering the casing 161 tangentially swirls therein and escapes from the casing through the sleeve 164 and annular openings 166 and 167 thereby sweeping the spin-off points 168. The stream 176 of more or less viscous material emerging from conduit 172 does not atomize or otherwise break up and, caught in the swirling air, impinges upon the inner surface of the sleeve 164 to be swept forwardly to the spin-off points 168 and therefrom by the fluid escaping from the sleeve and around it through openings 166 and 167.

In any of the various forms of spin-off point devices above described the parameters obtained will depend upon the type of congealable material employed and upon the type of filaments or fibers desired. Temperatures at and adjacent the spin-off points are to be controlled so as to insure that the material to be spun is of appropriate viscosity for spinning but not high enough to damage the material. For example, in spinning fibers or filaments from polypropylene, the material is ordinarily supplied to the spin-off device at a temperature from about 400 degrees to about 600 degrees F. Sweep fluid, air, or such other gas, ordinarily would have a temperature about that of the material or somewhat higher, although in some cases using thermoplastics supplied at relatively high temperature, it may be advisable that the sweep fluid be substantially cooler than the material to be spun. With thermoplastics, temperatures of course affect viscosities; the spinning of fine filaments requires lower viscosities than does the spinning of coarser filaments.

Ambient temperatures beyond the spin-off points may be of importance. With thermoplastics, if the incipient filaments are allowed to cool slowly while not maintained under tension, plastic memory may cause them to contract, or snap back, into pretzel-like snarls. This may be prevented, even in the absence of tension, by quick cooling produced, for example, by a cooling fog or mist. In some instances, as when the spun material is of a character such that its congealing requires heat-curing or drying, ambient temperatures may be higher than spinning temperature. Spinning temperature as referred to here may be simply the temperature of the space into which the sweep fluid carries spun fibers or the temperature of auxiliary fluid discharged against filaments after they have left the spin-off points or may be the temperature of a recirculated, precisely controlled fluid system. Ambient temperatures may also be significant in felting operations and other situations where the incipient filaments are deposited on other filaments, for in such situations temperature can determine the extent to which successively deposited filaments cohere. Coherence, or its absence, between successively deposited fibers may also be controlled by spraying the fibers with a liquid adhesive or with a release agent.

Sweep fluid velocities and nature of flow thereof can effect the filaments produced. Laminar flow of sweep fluid promotes the formation of straight filaments, while turbulent flow tends to produce crimped filaments. Crimped filaments can also be produced if the sweep fluid decelerates too rapidly before the filaments have set. Velocity of sweep fluid at a spin-off point affects the diameter of filament produced. For instance, raising from about 12 psi to about 25 psi the pressure of sweep fluid supply when air or gas is used, and thereby increasing the velocity of the sweep fluid at the spin-off has reduced filament diameter from 0.010" or 0.015" to 0.0005" or 0.0001". Even finer filaments are possible at higher pressures and lower viscosities of materials.

It has been pointed out above that the relation between sweep fluid velocity and the rate at which the spin-off point receives the congealable material affects the length of fibers or filaments produced. Specifically, the sweep fluid velocity can be made high enough that it intermittently strips the spin-off point completely and so terminates continuing lengthening of the filament being produced. As the feed of liquid material to the spin-off point continues, filament generation will resume when enough of the liquid has accumulated on the point. The length of the discontinuous fibers produced in this manner decreases as the velocity of the sweep fluid increases without a related increase in the rate of liquid supply. The fibers are especially well suited to being spun into thread, as they taper toward their ends. The tapered ends of fibers contribute to imparting a smooth feel to a felted sheet, yarn, or fabric. By use of an arrangement of unequally fed or swept points, a mixture of continuous and discontinuous filaments can be produced and subsequently formed into a filled yarn using drawing and plying known art.

Although the above description of illustrated embodiments all contemplate the use of air or other gas as the spinning fluid, there are cases in which the spinning can be performed by a liquid. For example, where the congealable material is a modified cellulose, or viscose, the spinning fluid could be a liquid of the acidic type used in the production of rayon to congeal the liquid streams emerging from a conventional spinneret.

Instead of sweeping the congealable material from a spin-off point with a fiber spinning fluid, the material can, if adequately viscous, be pulled from the tip of the spin-off point by a reel or like device. It will of course be understood that, in this method, the material leaving this spin-off point must be substantially congealed by the time it reaches the reel. Owing to its viscosity, the liquid material on the point will be drawn to the tip of the point to replace that pulled from the tip by the reel. The relation between the speed of the reel and the rate at which material is supplied to the point determines the size of the filament produced.

In every example given above, the spinning element is solid to the extent that it has an outwardly facing surface which tapers in to a point at one axial end of the element and from which point the liquid, or flowable, material is drawn to form a filament and which filament is then attenuated and caused to congeal. The fluid which sweeps the material along the spinning element to the point end thereof and which draws the material off the spinning point as a filament and conveys it away from the point while attenuating the filament is usually a gas, air, or burned air as from a pressure fed burner for example.

As has been mentioned above, the method and apparatus of the present invention is applicable to a variety of synthetic materials. Representative among the materials, which can be softened, or liquified by heat and which congeal upon cooling are polypropylene, polyethylene, certain of the polyvinylchlorides and polyamids.

Among the material which are rendered flowable by a solvent and which congeal by evaporation of the solvent therefrom are the cellulosic esters, acrylics and certain polyvinylchlorides.

An example of a material which congeals by catalytic action is a polyester resin. Viscose is an example of use of acidic congealments wherein the sweep air, or the air which impinges on the filament after it is attenuated, contains an acidic precipitant.

An example of a material which congeals by chemical action supplied to the material in the sweep fluid, or in fluid or air impinging on the filament is phenol-formaldehyde. In this case, an acidic vapor is employed to effect the congealing which could, for example, be hydrochloric acid. Alternatively, a fog consisting of or containing phosphoric or other acid could be employed. At least some of the resorcinol formaldehyde resins also fall in this classification.

In every case, fine nozzles to form filaments are eliminated, as well as the known problems attendant thereto. Filaments of controlled uniform diameter free of beaded ends are formed at an extremely rapid rate and can be individually twisted, twisted together in groups, matted, or otherwise processed.

Modifications may be made within the scope of the appended claims.

What is claimed is:

1. The method of forming fibers from a flowable thermoplastic fiber forming material comprising the steps of:

(a) feeding the flowable fiber forming material onto the outer surface of at least one spinning element which tapers inwardly to a terminal point in one axial direction, (b) establishing the flow of the fiber forming material along and substantially encasing the outer surface of the spinning element, (c) sweeping the fiber forming material with a flow of a heated fluid adjacent to and along the surface of the tapered spinning element toward its terminal point, (d) spinning the fiber forming material from the terminal point of the spinning element into uncongealed fibers under the continued influence of the sweeping fluid, (e) attenuating the uncongealed fibers under the continued influence of the sweeping fluid, and (f) cooling the uncongealed fibers to stabilize and form a uniform suspension in the sweeping fluid, and (g) collecting the congealed fibers.

2. The method according to claim 1 in which said fluid is gaseous.

3. The method according to claim 1 in which said material is a heat softenable material and is supplied to said region of the surface of said element at a temperature above the softening point of the material, and said fluid is gaseous, and the said filament is cooled to cause the said congealing of said material.

4. The method according to claim 2 in which the fluid flow is substantially non-turbulent in the sweep area.

5. The method according to claim 1 in which said fiber forming material is continuously and coaxially supplied as a solid rod which is melted by hot gaseous non-turbulent sweep fluid to continuously reform its own spin-off point.

6. The method according to claim 1 in which the velocity of said fluid exceeds that of said material flowing along the surface of said element to said point to such an extent that the filament drawn off said element at said terminal point is attenuated to the point of periodic interruption thereof whereby the filament produced is discontinuous.

7. The method according to claim 6 which includes the step of continuously collecting the portions of the discontinuous filament together in substantially parallel overlapping relation, and continuously intertwisting the said portions together to form a continuous thread.

8. The method according to claim 7 which includes supplying said portions in substantially random orientation to a support and interconnecting said portions to form a felted layer on the support.

9. The method according to claim 6 in which said fluid supplies a continuous filament.

10. The method according to claim 6 which includes use of a plurality of spinning points and feed controls giving a mixture of continuous and discontinuous fibers.

11. The method according to claim 1 which includes distributing a plurality of said spinning elements in spaced relation with the said terminal points thereof in substantially coplanar relation and all pointing in the same axial direction thereby to establish a plurality of point sources of filaments.

12. The method according to claim 11 in which said terminal points are distributed circumferentially about a central axis to provide a supply of filaments which can be gathered together in substantially parallel relation to form threads or rovings.

13. The method according to claim 11 which includes distributing said terminal points laterally with reference to a receiving surface thereby to provide a supply of filaments that can be layered in any desired condition of orientation on said surface.

14. The method according to claim 1 which includes distributing a plurality of said spinning elements in spaced relation with the said terminal points thereof in substantially coplanar relation and all pointing in the same direction thereby to establish a plurality of point sources of filaments, arranging a receiving surface in spaced relation to said elements and movable in a predetermined direction, and grouping said elements in two locations spaced in the direction of movement of said receiving surface whereby each group of said elements will supply filaments to said surface to form respective layers thereon, and causing said layers to adhere to each other.

15. The method according to claim 14 whereby at least one said parallel coplanar multiple fiber forming unit generates and delivers a mass of hot fibers to an in running roll nip to effect lamination of same.

16. The method according to claim 14 whereby the hot fibers are carried by the hot fluid to a web or article having a heat sensitive coating and impaled thereon as a bonded flaccid coating.

17. The method according to claim 16 in which the filaments in each layer are substantially parallel and the filaments of the respective layers are disposed angularly to each other.

18. The method according to claim 1 which includes supporting a plurality of said spinning elements in circumferentially spaced relation in a circular path about a central axis and with all of the terminal points of said elements pointing in the same tangential direction, rotating said plurality of elements as a body about said axis with the terminal points thereof pointing rearwardly, and causing said fluid to flow in a circular path about said plurality of elements and in a direction opposite to the direction of rotation of said elements.

19. The method according to claim 1 which includes causing said fluid to take a rotary motion about the axis of said spinning element to impart a twist to the filament being drawn off said terminal point before the material of the filament is congealed.

20. The method according to claim 1 which includes supporting a plurality of spinning elements in a circular path about a central axis and with all of the terminal points of said elements pointing in the same direction, and causing said fluid to take a rotary motion about said central axis to cause the several filaments which are drawn off from said terminal points to become twisted together.

21. The method of claim 1 in which the thermoplastic fiber forming material contains chemically reactive components which modify the properties of the resultant fibers.

22. The method of claim 1 in which the attenuating of the uncongealed fibers under the continuing influence of the sweep fluid is followed by the supplemental sweeping action of an accelerating ring.

23. The method of forming a continuous fibrous strand from a flowable thermoplastic fiber forming material which comprises the steps of:

(a) forming fibers in a first spinning zone by sweeping a thermoplastic fiber forming material along and off the point of a spinning element by means of a pressurized sweep fluid thereby attenuating the uncooled and unstabilized fiber and providing a secondary cooling fluid to cool, congeal and form a uniform fibrous suspension in the sweep and cooling fluids, (b) conveying the pressurized and cooled fluid suspension of fibers tangentially into a second zone formed by a cyclonic twisting device for twisting the fibers into substantially parallel fibers, (c) separating the substantially parallel fibers from the fluid in the central zone of the cyclonic twisting device, (d) intertwisting the fibers in the final vortex zone of the cyclonic device, and (e) withdrawing and collecting the twisted strand continuously from the cyclonic device.

24. The method of claim 23 in which the fibers are twisted at the rate of at least 25,000 twists per minute.

25. The method of claim 23 in which the cyclonic twisting device has a maximum internal diameter of the fluid containing zone of six inches.

26. The method of claim 23 which includes:

(a) pulling the twisted strand continuously from the cyclonic device by means of a roll pulling device having a controlled speed and firm grip on the strand, (b) stretching the twisted strand in a drawing third zone having a controlled temperature and a pulling device with a greater surface speed than the roll pulling device, and (c) winding the twisted and drawn strand into a package.

* * * * *

UNITED STATES PATENT AND TRADEMARK OFFICE

CERTIFICATE OF CORRECTION

PATENT NO. : 4,211,736

DATED : July 8, 1980

INVENTOR(S) : Rexford H. Bradt

It is certified that error appears in the above—identified patent and that said Letters Patent is hereby corrected as shown below:

Column 2, line 57, "is" should read -- in --.

Column 11, line 3, "material" should read -- materials --

Signed and Sealed this

Eleventh Day of November 198(

[SEAL]

Attest:

SIDNEY A. DIAMOND

Attesting Officer

Commissioner of Patents and Trademarl